United States Patent [19]

Camacho

[11] 4,214,325

[45] Jul. 29, 1980

[54] DISMOUNTABLE FRAME FOR CHILDREN'S FURNITURE

[75] Inventor: Carlos J. Camacho, Barcelona, Spain

[73] Assignee: Forminfan, S.A., Granollers

[21] Appl. No.: 943,215

[22] Filed: Sep. 18, 1978

[51] Int. Cl.[2] ..... A47C 27/08

[52] U.S. Cl. ..... 5/99 B; 5/11; 256/25

[58] Field of Search ..... 5/11, 94, 97, 98, 99 R, 5/100; 256/25

[56] References Cited

U.S. PATENT DOCUMENTS

| | | | |
|---|---|---|---|
| 2,348,012 | 5/1944 | Levi | 5/99 B |
| 3,979,783 | 9/1976 | Spencer | 5/99 B |

FOREIGN PATENT DOCUMENTS

| | | | |
|---|---|---|---|
| 253721 | 4/1967 | Austria | 5/99 R |

*Primary Examiner*—Casmir A. Nunberg

*Attorney, Agent, or Firm*—Haseltine, Lake & Waters

[57] ABSTRACT

A collapsable frame for children's furniture, of the type which is formed of a rectangular enclosure with four independent side members. The side members are fixed together but detachable from each other and a base. In application to a playpen, the base is made up of two co-planar sections which on their two opposing edges have tongues on each in the continuous plane for support and abutt against their respective lower side beams of the two opposite side members. The lower side beams of the cther two side members carry the support of the corresponding edges of the base panels, which edges abutt against the bars of the side members, thus providing rigidity of the entire frame.

2 Claims, 3 Drawing Figures

DISMOUNTABLE FRAME FOR CHILDREN'S FURNITURE

BACKGROUND OF INVENTION

Figure 1:
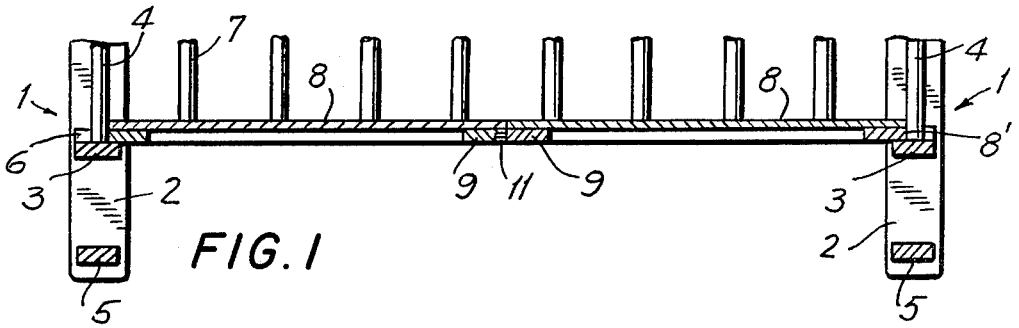

The present invention refers to an improved dismountable frame for children's furniture which has been designed for the construction of playpens, made up of four independent side members which can be fixed together and are detachable and a base.

The dismountable frame referred to above is characterized by the advantage that its dismantling does not require any complicated accessories and when dismantled, its components can be stacked so that they require only a small space thus making the transport and the storage extremely easy.

SUMMARY OF THE INVENTION

The main object of the present invention is to overcome the defects of the prior art.

Characteristic of these improvements is the fact that the base of the frame in the above application for the assembly of playpens comprises two co-planar sections with continuous tongues with the plane on their respective facing edges. These tongues each rest on and abutt against the lower side beams of the two side frames which are oppositely placed. On the lower side beams of the other two side frames rest the corresponding sides of base sections, the edges butting against the bars of the aforementioned side frames, all of which ensures the rigidity of the entire structure.

The present invention will be better understood with respect to the accompanying specification, claims and drawings.

Figure 3:
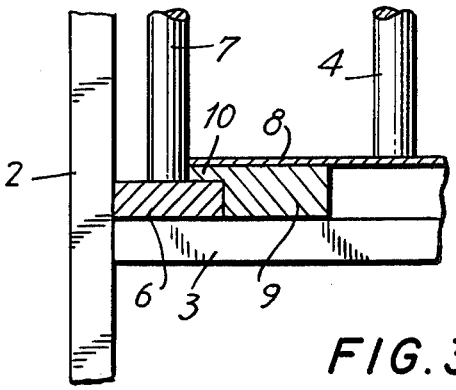
Figure 2:
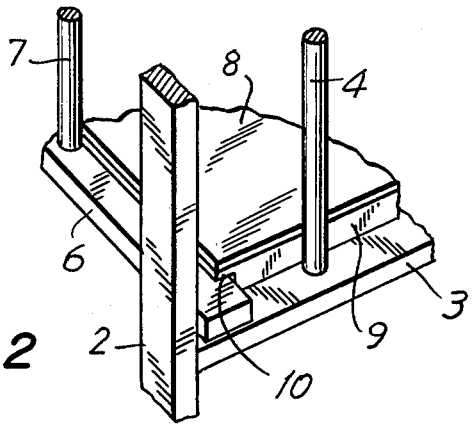

In the drawings;

FIG. 1 is a view in elevation which illustrates the arrangement of the base in the frame, FIG. 2 shows the detail of the assembly in perspective of the base in the frame, and FIG. 3 shows further detail in elevation of the said assembly.

DESCRIPTION OF INVENTION

As is shown in the drawings the dismountable frame assembly can be described as consisting of two side sections 1 identical and opposite with feet 2 to which are attached an upper sidebeam (not visible) and a lower side beam 3 being interconnected by bars 4. The feet 2 being connected on the lower part by a traverse 5 situated below the side beam 3. The frame assembly includes two further identical and mutually opposite side members with an upper side beam (not visible) and a lower side beam 6 both interconnected by bars 7. The side beams of these latter side members are each fitted at their ends with pegs which fit into holes in the side beams of the other two side members all thus making up a square frame.

The frame assembly includes a base consisting of two panels 8 joined upon frameworks 9 which on the two facing edges have the respective continuous 10 which tongues rest on and butt against the lower side beams 6 of the two corresponding opposite side members. The lower side beams 3 of the other side members rests on the corresponding edges 8 of the panels which butt against the bars 4 after locating the pegs 11 of the framework 9 of one of the base panels in the cavities in the framework of the other of the parts, thus providing the completed rigid assembly.

The invention, within its essential substance can be applied in other forms of application which differ solely in detail from that which is shown by way of example and to which the protection hereby solicited extends. This frame can therefore be made in any shape and size with the means and materials most appropriate and the most suitable accessories while remaining entirely within the spirit of the following claims.

It is hereby claimed as object of the present invention:

1. An improved collapsable frame assembly for furniture, of the type employing a rectangular enclosure formed by four independent side members, said side members are fixed together but detachable from each other and a base member, said improvement comprising: the base is made up of two co-planar sections which on two opposing edges are provided with tongues, in the continuous plane for support and abutting against respective lower side beams of two opposite side members, said lower side beams of the other two side members formed to support the corresponding edges of base panels whose edges butt against the bars of the said members providing rigidity to the entire frame.

2. An improved frame assembly as claimed in claim 1, wherein: said frame is employed in a children's playpen.

* * * * *